US005678943A

United States Patent [19]

Parsons

[11] Patent Number: 5,678,943

[45] Date of Patent: Oct. 21, 1997

[54] ACCESSORY DEVICE AND METHOD FOR MAKING THE SAME

[76] Inventor: Thomas C. Parsons, 228 Huntington St., New Haven, Conn. 06511

[21] Appl. No.: 589,162

[22] Filed: Jan. 22, 1996

[51] Int. Cl.[6] ..... B42F 13/00

[52] U.S. Cl. ..... 402/79; 281/38; 281/31; 402/4

[58] Field of Search ..... 281/28, 29, 30, 281/38, 51; 402/79, 4, 70, 73

[56] References Cited

U.S. PATENT DOCUMENTS

| | | | |
|---|---|---|---|
| 229,046 | 6/1880 | Low . | |
| 328,161 | 10/1885 | Watson . | |
| 392,066 | 10/1888 | Razall . | |
| 724,849 | 4/1903 | Gresham . | |
| 812,515 | 2/1906 | Munster . | |
| 1,316,039 | 9/1919 | James . | |
| 1,415,429 | 5/1922 | Cueny . | |
| 1,604,028 | 10/1926 | Dinkler . | |
| 4,004,690 | 1/1977 | Giarritta . | |
| 4,350,195 | 9/1982 | Viesturs et al. . | |
| 4,441,270 | 4/1984 | Crowell et al. . | |
| 4,706,396 | 11/1987 | Nomura . | |
| 4,869,452 | 9/1989 | Bennett . | |
| 5,048,869 | 9/1991 | Schwartz . | |
| 5,165,721 | 11/1992 | Schwartz . | |
| 5,476,336 | 12/1995 | Osiecki et al. | 402/79 |
| 5,620,271 | 4/1997 | Bergh et al. | 402/79 |

*Primary Examiner*—Willmon Fridie, Jr.

*Attorney, Agent, or Firm*—St. Onge Steward Johnston & Reens LLC

[57] ABSTRACT

An accessory device is shown for use with a host object. The host object has a central axis and a plurality of pages at least partially rotatable about the central axis, each of the pages having a remote edge. The accessory device includes a connector having a proximal end and a distal end and means for removably connecting the proximal end of the connector to the host object. The accessory device also includes an extension member, having a proximal end and a distal end, which is sized and shaped such that at least a portion of the extension member is slidably movable about the connector, allowing the extension member to be movable between an extended position and a retracted position. As the extension member slides about the connector from the extended to the retracted position, the proximal end of the extension member is brought closer to the proximal end of the connector. As the extension member slides about the connector from the retracted to the extended position, the proximal end of the extension member is brought substantially adjacent to the distal end of the connector such that a substantial portion of the extension member extends beyond the remote edge of at least one of the pages of the host object.

22 Claims, 6 Drawing Sheets

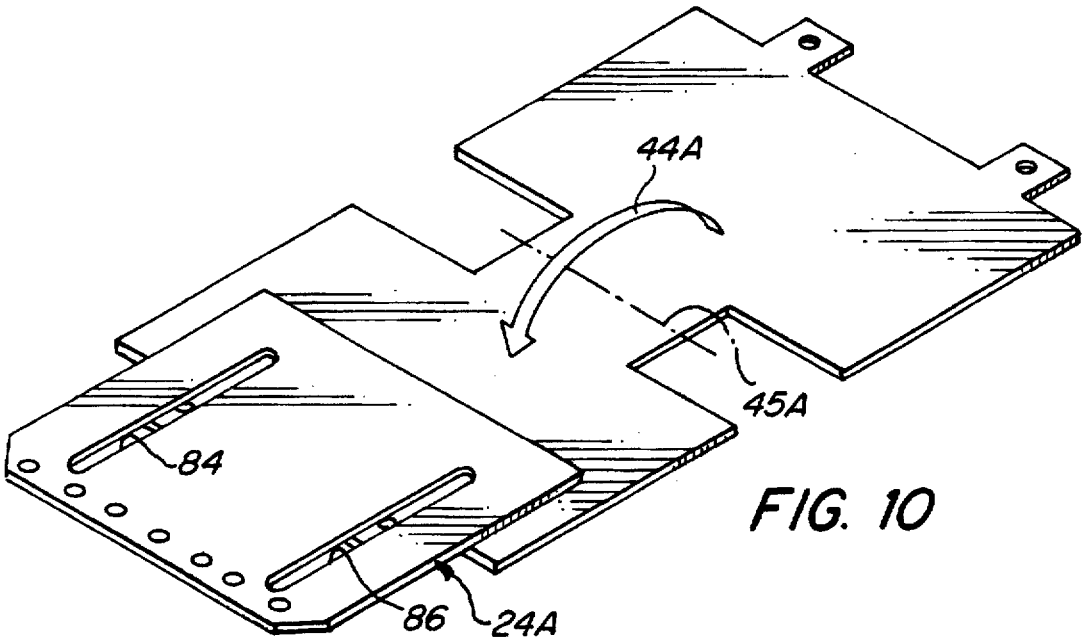
FIG. 10
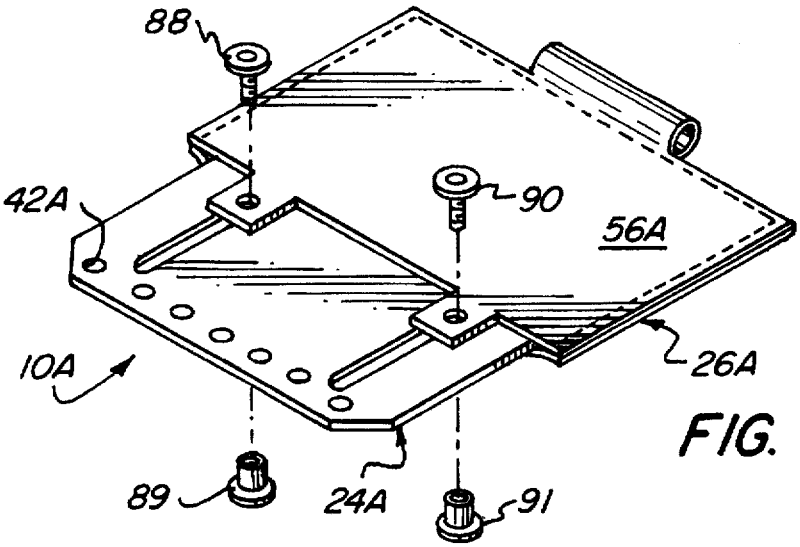
FIG. 11
FIG. 12
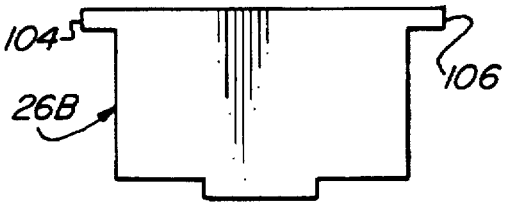
FIG. 13
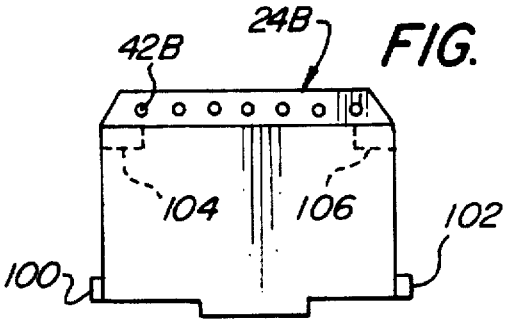

ACCESSORY DEVICE AND METHOD FOR MAKING THE SAME

CROSS REFERENCE TO RELATED APPLICATION

This application claims priority from a copending provision application, which was filed by Thomas C. Parsons on Oct. 17, 1995, entitled "Accessory Book Extension."

FIELD OF THE INVENTION

The present invention relates to books, such as multiplering binders and the like, and more particularly, to accessories therefore.

BACKGROUND OF THE INVENTION

Individuals commonly find it necessary to consult a source of information, such as a file, book or binder, and simultaneously take notes therefrom or make entries on a separate and distinct notepad. Further, it is sometimes necessary for individuals to access an accessory device, such as a calculator or stop watch, while concurrently referencing the source of information, such as the aforementioned file, book or binder.

For example, it is oftentimes necessary for airplane pilots to consult reference materials. As is known, airplane cockpits are generally designed to take maximum advantage of all available space; thus, the amount of storage space available for the pilot's reference materials is limited. Additionally, pilots must wear safety belts and shoulder harnesses at all times while seated at the controls of the aircraft. Thus, the requirement of belts and harnesses place limitations on the pilot's mobility. Additionally, because pilots use one hand to perform control functions, and because various functions are performed throughout the course of the flight, pilots have only one hand free to perform other necessary functions.

While it is true that most airline crews consist of at least two pilots, and that, accordingly, the flying tasks are shared, many other types of flight operations exist that involve single pilot crews. Thus, there are many other situations where there is no co-pilot to share the flying duties.

It is at times necessary for a pilot to perform many tasks simultaneously. For example, all of the following tasks could be required of one pilot at a single instance: locate and review information from a book, binder or chart; calculate or time the duration of certain events; copy complex instructions from an air traffic controller; and manipulate the controls of the aircraft.

Under ideal conditions, and especially under adverse or emergency conditions, locating accessory materials and bringing them into use while already consulting a given source of information and simultaneously manipulating the aircraft's controls take time and may draw the pilot's attention away from higher priority activities.

Several devices attempt to address some of these problems. Some of these accessory devices, such as that one shown in U.S. Pat. No. 5,048,869 to Schwartz, comprise extension members which are pivotably attached to a connector which is then attached to a host book or binder. The pivotably attached extension member is undesirable, however, because the amount of surface area exposed by extension member is always the same; accordingly, this surface area may be suitable for some large work spaces, but unsuitable when used in rather crowded or cramped working conditions. In addition, to access the pivotably attached extension member, it is often necessary to first locate the extension member, then turn the book (or host object) to the pivot point of the extension member and then turn back to the reference page. This involves an undesirable number of steps. Indeed, it is so complicated that it would be difficult for a pilot to use while also trying to fly an aircraft.

Additional drawbacks of the prior art devices are known. Some of the known devices comprise extension members which, when in the extended position, are not sufficiently rigid to allow a user to write upon it or otherwise perform some work functions without some external reinforcement.

Further, some of the prior art devices are not capable of being extended and retracted with a single hand. This is a significant drawback, especially to airplane pilots, who are frequently performing some flying duties, such as moving gauges and levers, with one hand.

What is desired, therefore, is an accessory device which can be easily removed from and connected to an existing book or binder; which has an adjustable amount of work surface; which can be conveniently stored together with the accessory device; and which can be used as a writing surface without external reinforcement.

SUMMARY OF THE INVENTION

Accordingly, it is an object of the present invention to provide an accessory book extension which is easily removably connected to an existing binder or book.

It is another object of the present invention to provide an accessory book extension which is small and lightweight yet durable.

It is still a further object of the present invention to provide an accessory device, which, when connected to a reference book, allows a user to take notes from the reference book in a minimum amount of space.

It is yet another object of the present invention to provide an accessory device which can be extended from the host object in incremental amounts.

It is still another object of the present invention to provide an accessory device which can be easily extended by the user while using only one hand.

It is an even further object of the present invention to provide an accessory device having a surface that, when either partially or completely extended, is sufficiently sturdy to withstand the pressures normally applied when used as a writing surface without the need for external reinforcement.

It still another object of the present invention to provide an accessory device that is sufficiently sturdy to withstand the forces normally encountered in turbulent conditions aboard an aircraft.

It is still another object of the present invention to provide an accessory device which can be used with minimum interference to the host object.

To overcome the deficiencies of the prior art and to achieve the objects and advantages listed above, an accessory book extension is shown which is quickly and easily removably connected to a host object, such as a binder. As is known, the host object comprises a central axis and a plurality of pages at least partially rotatable about the central axis; each of the pages has a remote edge. The accessory device comprises a connector having a proximal end and a distal end and means for removably connecting the proximal end of the connector to the host object; and an extension member having a proximal and a distal end and sized and shaped such that at least a portion of the extension member is slidably movable about the connector in a linear direction.

The extension member further comprises at least one stop member or mechanism positioned so as to delimit movement of the extension member. Preferably, the stop members comprise grommets which are positioned along one edge of the extension member and located with respect to at least one cooperating tab, protruding from an edge of the connector.

In operation, as the extension member moves from an extended to a retracted position, the proximal end of the extension member is brought closer to the proximal end of the connector. Contrariwise, as the extension member moves from the retracted to the extended position, the proximal end of the extension member is brought substantially adjacent to the distal end of the connector. Advantageously, in the extended position, a substantial portion of the extension member extends beyond the remote edge of at least one of the pages of the host object, allowing a user to take notes from the host object as desired.

When the user completes the task, the extension member can be quickly and easily moved to the retracted position and substantially housed in the host object. As such, the accessory device can be stored away while taking up a minimum amount of space. Further, operation of the accessory device is accomplished with little disruption to the host object.

The invention and its particular features and advantages will become more apparent from the following detailed description when considered with reference to the accompanying drawings.

BRIEF DESCRIPTION OF THE DRAWINGS

FIGS. 9–11 are isometric views of the steps for making the accessory book extension shown in FIG. 8, with the pencil removed for clarity;

FIGS. 12–13 are schematic views of an alternate embodiment;

DETAILED DESCRIPTION OF THE DRAWINGS

Figure 1:
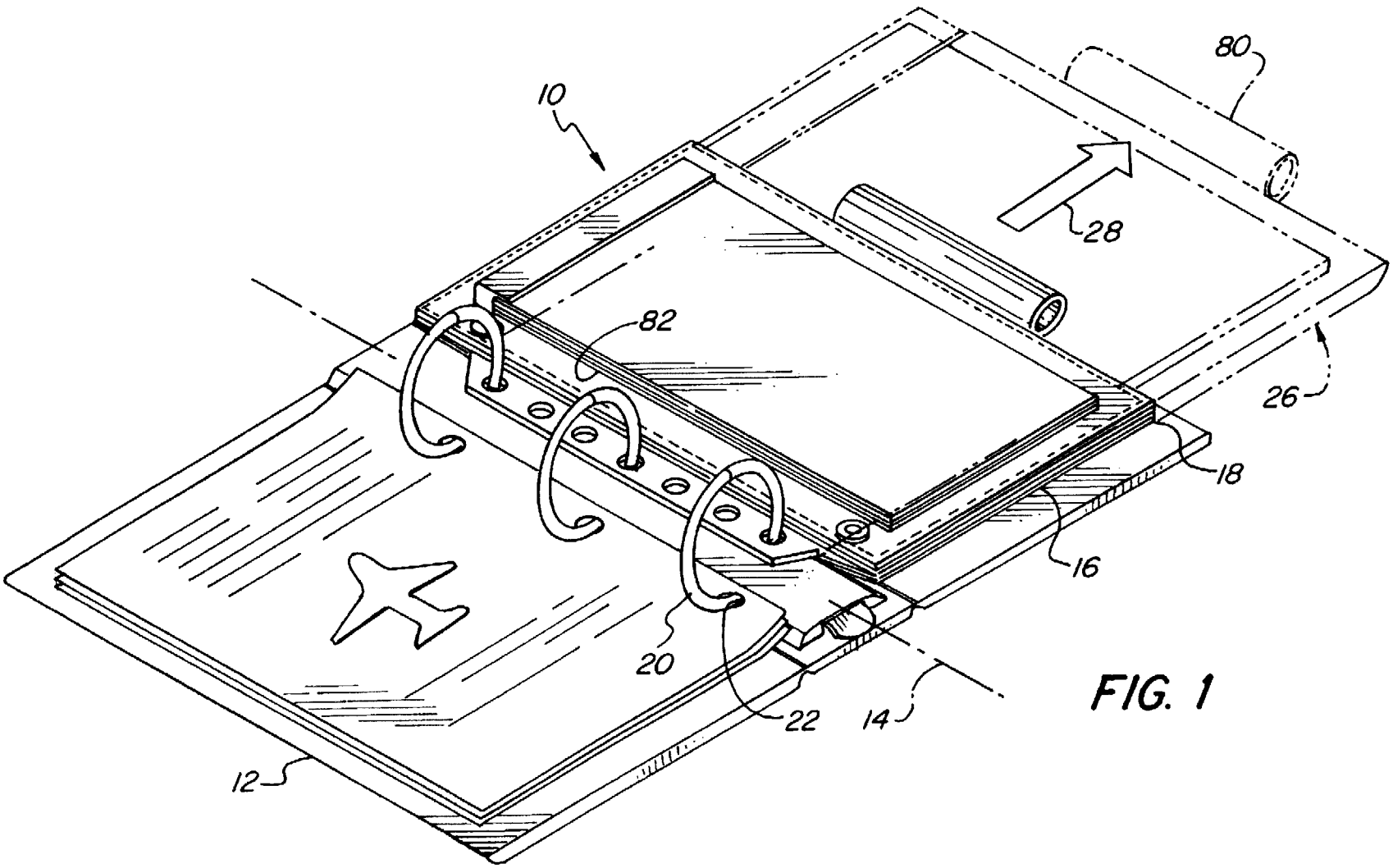
FIG. 1 is an isometric view of an accessory device, constructed in accordance with the present invention, shown with a pad of paper inserted into a pocket, the device being removably connected to a multiple-ring binder.

Referring to the drawings in detail, an accessory device (sometimes referred to as an accessory book extension) is shown and generally designated by the reference numeral 10. It should be noted that for the sake of clarity not all of the components and parts of accessory book extension 10 may be shown and/or marked in all the drawings. Further, as used in this description, the terms "up", "down", "top", "bottom", etc. refer to accessory book extension 10 when in the orientation illustrated in FIGS. 1, 1A and 2, for example, although it should be recognized that accessory book extension 10 may be in any of various orientations when in use, the orientation illustrated in FIGS. 1 and 2 not being necessary for operability.

Referring to FIG. 1, accessory device 10 may be used with any suitable host object 12. Some suitable host objects include, but are not limited to, binders, such as binders having multiple rings (such as three-ring binders as shown in FIG. 1) and books 12C (such as that shown in FIG. 14). Host object 12 has been described herein as a three-ring binder for convenience only; the accessory device 10 is not intended to be limited to such.

As is known in the art, host object 12 generally comprises a central axis 14 and a plurality of pages, such as 16, which are at least partially rotatable about the central axis 14 of the host object 12. Each of the pages, such as 16, has a remote edge, such as 18. Multiple rings, such as 20, for example, are generally symmetrically positioned about central axis 14 of host object 12 and the pages, such as 16, are removably connected to the host object 12 by insertion of at least one of the rings 20 through a corresponding hole 22 in the page, as is known in the art.

Figure 2:
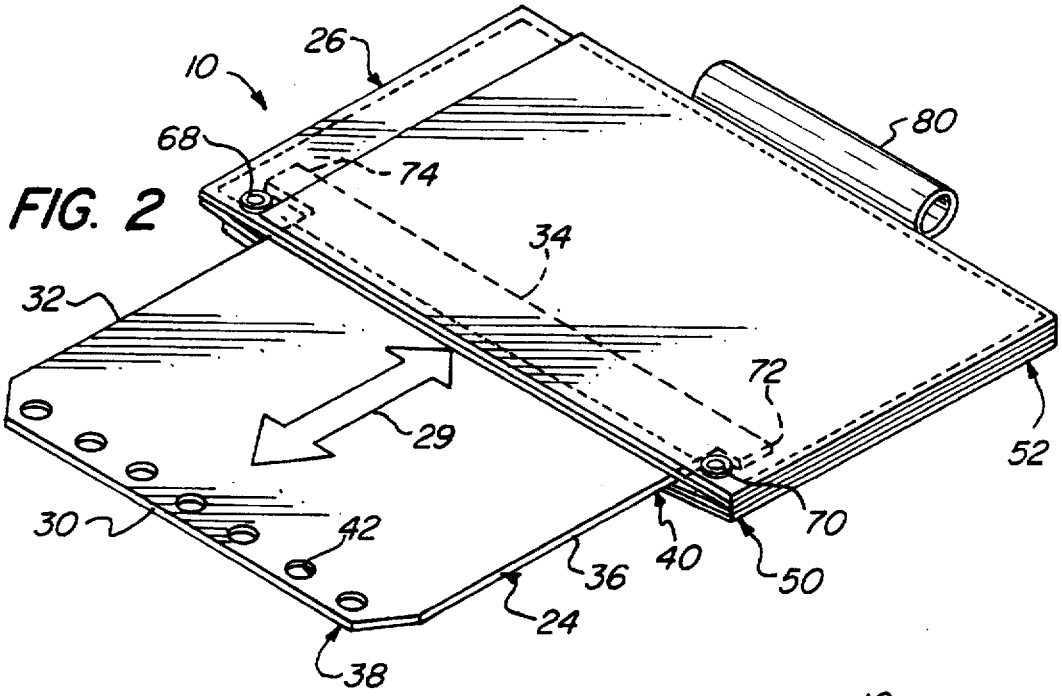
FIG. 2 is an isometric view of the accessory device of FIG. 1 in the extended position, wherein the pad of paper and the multiple-ring binder have been removed for clarity.
Figure 3:
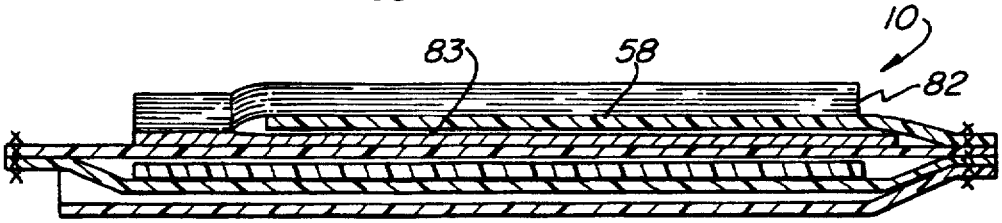
FIG. 3 is a cross-sectional view of the device shown in FIG. 1A, taken along line 3—3.

As best shown in FIG. 2, accessory device 10 comprises a connector 24 and an extension member 26, both being sized and shaped such that at least a portion of the extension member 26 is slidably movable about the connector 24 in a linear direction as indicated by arrow 28 (FIG. 1) and 29 (FIG. 2) so as to move extension member 26 between an extended position (FIG. 2) and a retracted position (FIG. 1) with respect to connector 24.

Connector 24 can be made of any suitable material which has the structural integrity to maintain its shape when extension member 26 slides about it, i.e., when moving between the extended and the retracted positions. Preferably, connector 24 is made of substantially rigid material such as plastic, which is commonly known in the art.

Referring to FIG. 2, connector 24 comprises a substantially rigid sheet of material having a plurality of edges 30, 32, 34, 36, a proximal end 38 and a distal end 40, and means 42, positioned substantially at the proximal end 38 and substantially along one of the edges 30, for example, for removably connecting the proximal end 38 of connector 24 to host object 12. FIG. 1.

Any suitable means can serve as the connecting means. For example, as shown, connecting means 42 may comprise a plurality of holes having a size sufficiently large to removably connect connector 24 to at least one of the rings 20, of host object 12. Other connecting means include, but are not limited to, VELCRO strips, hooks and fasteners (not shown). It should be understood that any suitable connecting means may be used so long as connector 24 is suitably connected to host object 12. It should further be understood that, although accessory device 10 is preferably removably connected to the host object 12, it may be desirable to permanently connect the two together by making modifications which become obvious after reading this disclosure.

Figure 1A:
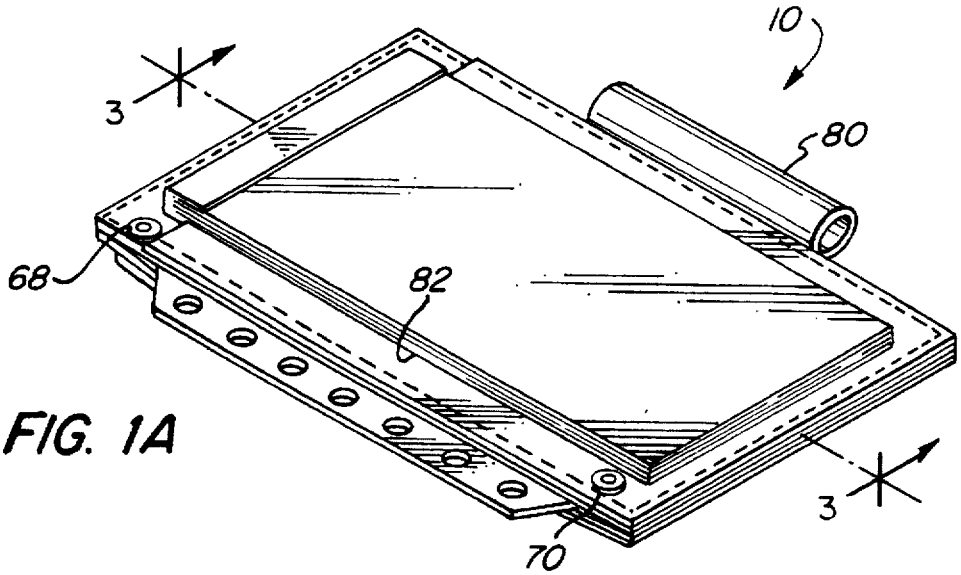
FIG. 1A is an isometric view of the accessory device of FIG. 1 in the retracted position, the multiple-ring binder being removed for clarity.

Extension member 26 may be made of any suitable material known in the art, but is preferably made of substantially rigid material, such as plastic, which maintains its shape when used as a writing surface without external reinforcement. Referring to FIGS. 1A, 3, 4–6, extension member 26 generally comprises at least one sheet 43 folded along fold-line 45 in the direction shown by arrow 44 (FIG. 6) to form an least one, but preferably two, mounting members 46, 48. Members 46, 48 are joined along bout three edges to form a pocket 54 (sometimes referred to as an envelope). At least a portion of connector 24 is positioned in pocket 54 (FIG. 6) so as to allow extension member 26 to move about connector 24 between the extended (FIG. 2) and retracted positions (FIG. 1A). When assembled, extension member 26 comprises a proximal end 50 and a distal end 52.

Preferably, at least one of the mounting members, such as 46, further comprises an outer surface 56. A sheet of material 58, such as a sheet of plastic, is attached to outer surface 56 along about three sides 60, 62, 64 of sheet 58 so as form apocket therewith. A user may use the pocket for any desirable purpose. For example, as shown in FIG. 1, a support member 83 (FIG. 3) of a pad of paper may be removably inserted into the pocket to provide writing material for a user. It should be understood, however, that any useful article may be attached to the extension member 26, such as a calculator, a small computer, another booklet, a set of tools or the like (not shown).

In the preferred embodiment, as shown in FIGS. 1, 1A, 2, at least one and preferably two stop members 68, 70, or mechanisms, are positioned so as to cooperate with tabs 72, 74 (FIGS. 2, 6), which protrude from two of the edges 76, 78 (FIG. 6) of connector 24, to delimit movement of extension member 26. Any suitable stop members and any desirable number of stop members may be used so long as they sufficiently delimit the movement of extension member 26. As shown in FIGS. 1, 1A, 2 and 7, stop members 68, 70 preferably comprise grommets which are positioned at opposite ends of one edge 60 (FIG. 5) of extension member 26. It should be understood, however, that any suitable stop mechanism could be used and could be positioned in any desirable location, so long as the movement of extendible member 26 between the extended and the retracted position is suitably controlled.

Figure 8:
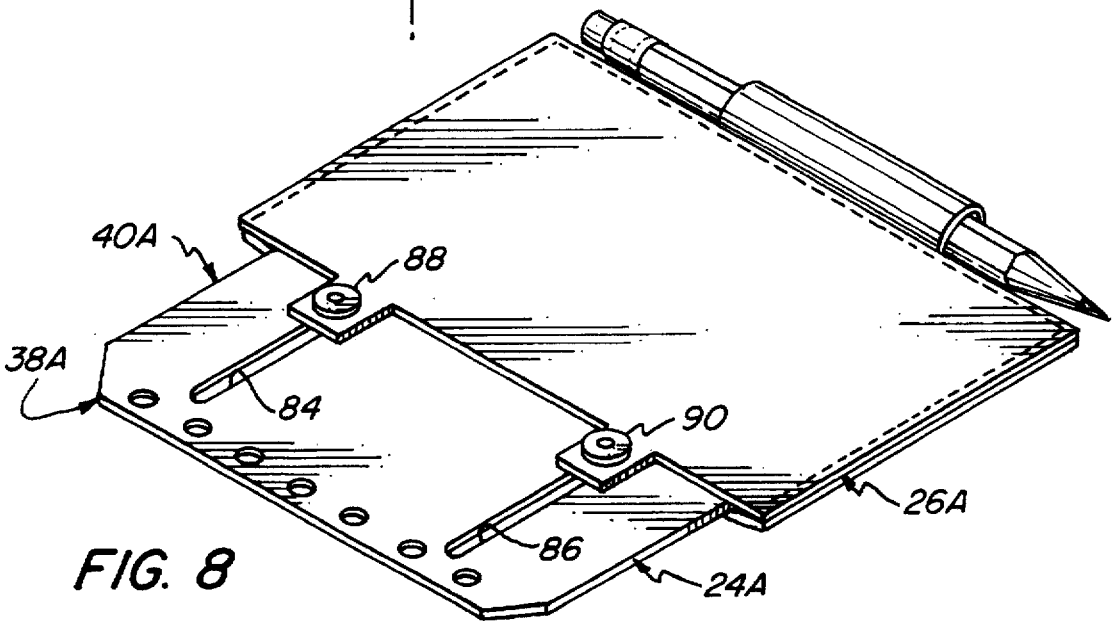
FIG. 8 is an isometric view of an alternate embodiment of an accessory device, with a pencil inserted into a loop formed thereon.

Referring to FIGS. 1, 1A, 2, extension member 26 also comprises a loop 80. Loop 80 acts as a handle for a user when moving extension member 26 between positions and serves as a holder or partial container for a user's writing implement. See FIG. 8.

In operation, extension member 26 is slidable about connector 24 from the extended position (FIG. 2) to the retraced position (FIG. 1A) in the direction shown by arrow 28 (FIG. 1), such that proximal end 50 (FIG. 2) of extension member 26 is brought closer to proximal end 38 of connector 24; in the retracted position (FIG. 1A), connecting means 42 is preferably substantially exposed. Contrariwise, referring to FIG. 1, when extension member 26 slides about connector 24 from the retracted to the extended position, proximal end 50 of extension member 26 is brought closer to and substantially adjacent to distal end 40 of connector 24 such that a substantial portion of extension member 26 extends beyond the remote edge, such as 18, of at least one of pages 16 of host binder 12.

Figure 4:
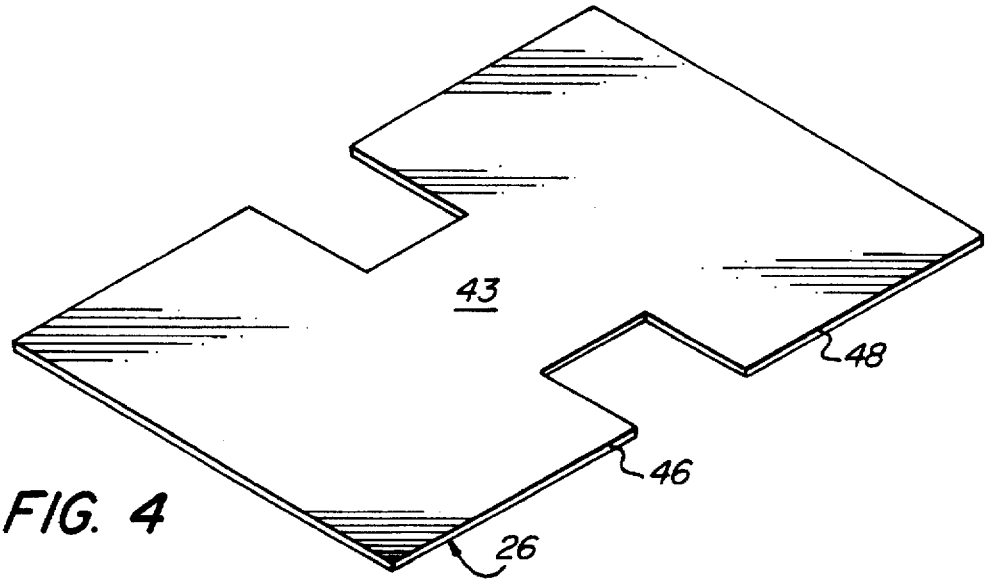
FIG. 4 shows a first step in the method of making the accessory device of FIG. 1.
Figure 5:
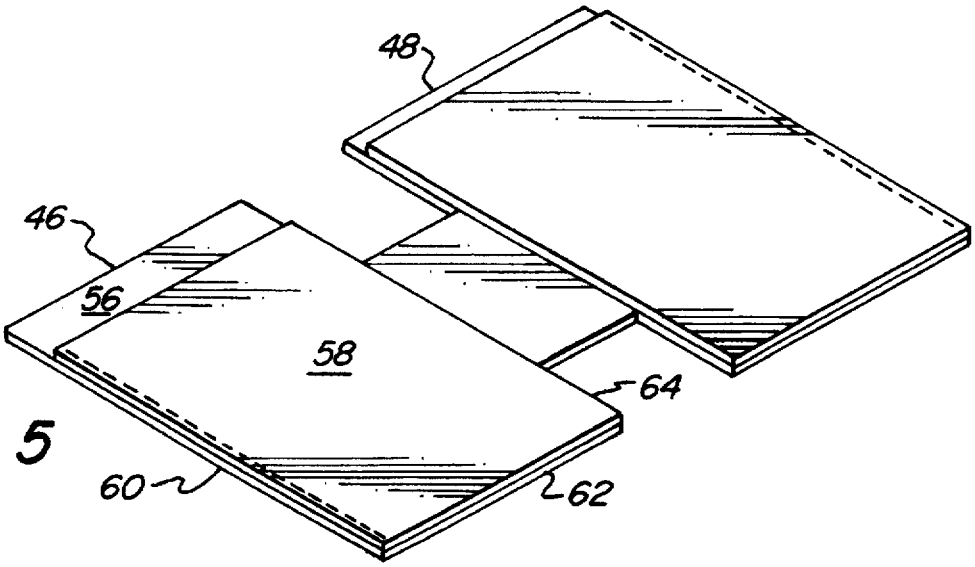
FIG. 5 shows the step of forming pockets on the sheet provided in FIG. 4.
Figure 6:
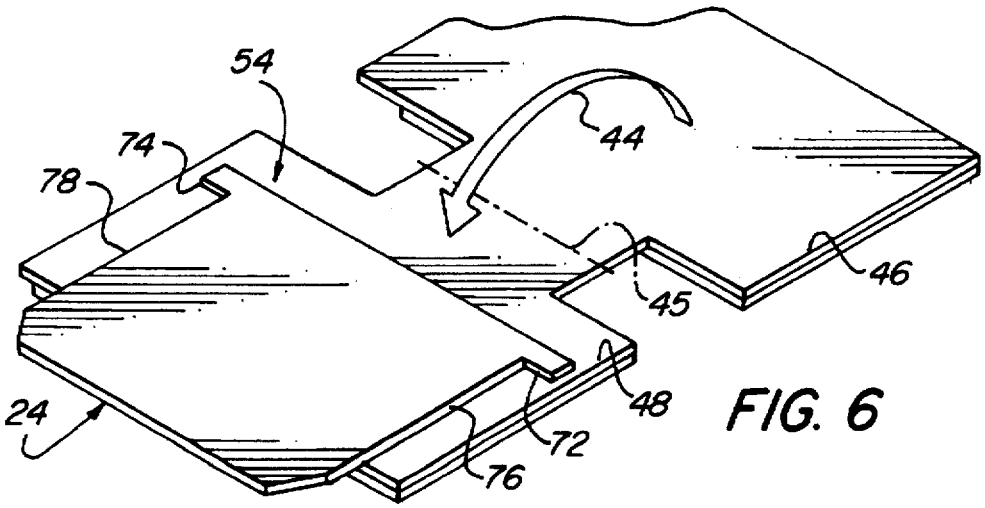
FIG. 6 shows the step of inverting the device shown in FIG. 5 so that the pockets are underneath, placing a connector on a portion of the sheet and folding the same.
Figure 7:
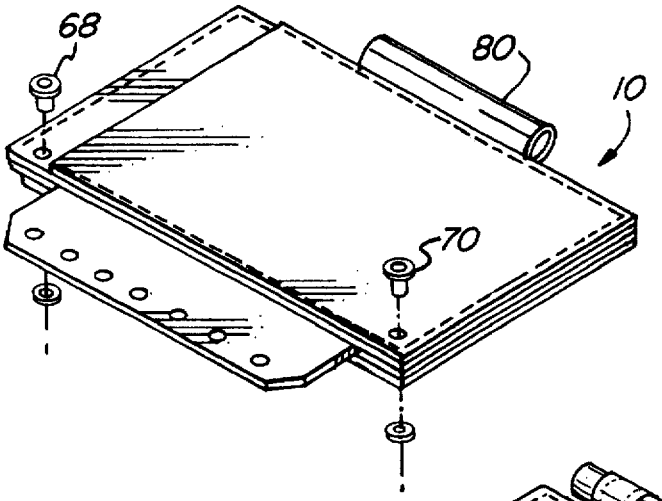
FIG. 7 shows the step of positioning stop members so as to render the device shown in FIG. 1.

A method of making the accessory book extension 10 in accordance with the present invention comprises the following steps. As shown in FIG. 4, extension member 26 is formed from a single sheet 43 of substantially rigid material. Connector 24 is formed having a plurality of edges 30, 32, 34, 36 and at least one tab, but preferably two tabs 72, 74 extending from at least two of the edges, as shown in FIG. 2. Connector 24 is placed over at least a portion of unfolded extension member 26 such that tabs 72, 74 are positioned on at least a portion of extension member 26. FIG. 6. Extension member 26 is then folded along fold-line 45 in the direction shown by arrow 44 so as to encase at least a portion of connector 24 including tabs 72, 74 therein. At least one and preferably two stop members 68, 70 are positioned along one edge of extension member 26 so as to cooperate with tabs 72, 74 of connector 24 to delimit movement of extension member 26. FIG. 7. A sheet 58 is positioned on outer surface 56 of extension member 26 to form a pocket which may be used to contain a support member 83 (FIG. 3) of a writing pad 82, for example.

In the alternate embodiments discussed below, it should be understood that like elements have a suffix attached to the corresponding reference numeral. For example, the connector is referred to in the preferred embodiment as element 24 and in the alternate embodiments as "24A", "24B" and "24C", respectively.

In an alternate embodiment, connector 24A is constructed in substantially the same manner as previously described, however, rather than using tabs to cooperate with stop members to delimit the movement of the extension member, connector 24A comprises at least one slot and preferably two slots 84, 86 which extend at least partially between proximal end 38A and distal end 40A of connector 24A. Extension member 26A is also constructed in substantially the same manner as previously described, however, rather than using stop members 68, 70 (FIG. 1, for example), extension member 26A comprises at least one and preferably two stop members 88, 90, each being positioned in at least a portion of one of the slots 84, 86 for delimiting movement of extension member 26A.

Figure 9:
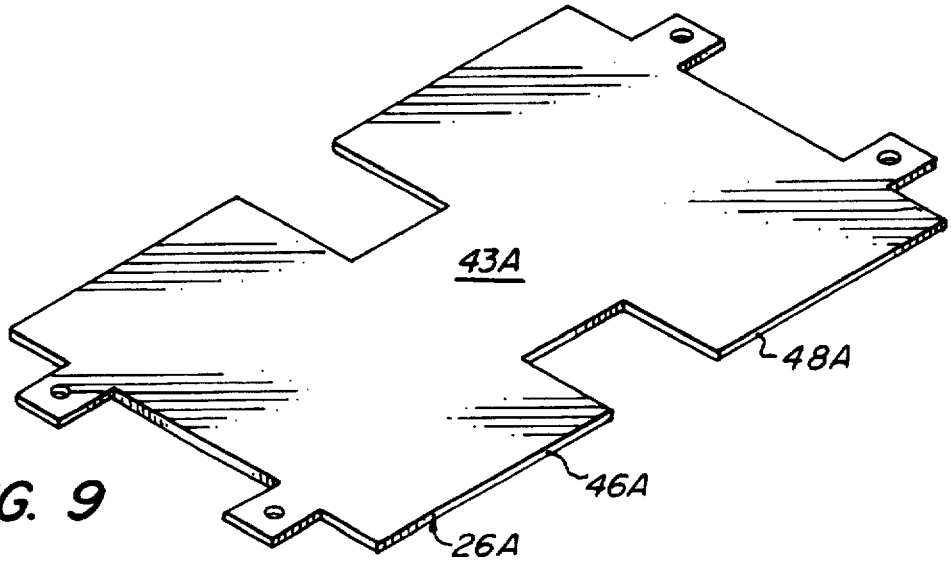

A method of making the aforementioned alternate embodiment is shown in FIGS. 9–11 and generally comprises the following steps. A sheet 43A is provided having at least one and preferably two mounting surfaces 46A, 48A. See FIG. 9. Connector 24A is formed having at least one and preferably two slots 84, 86. Connector 24A is positioned over at least a portion of unfolded extension member 26A. FIG. 10. Extension member 26A is then folded along fold-line 45A in the direction shown by arrow 44A so as to encase at least a portion of connector 24A. At least one and preferably two stop members 88, 90 having corresponding caps 89, 91 are positioned through extension member 26A and corresponding slots 84, 86. FIG. 11. It should be understood that a sheet (not shown) may, if desired, be positioned on outer surface 56A of extension member 26A to form a pocket which may be used to contain a support member 83 (FIG. 3) of a writing pad 82, for example.

Another alternate embodiment is shown in FIGS. 12, 13. Referring in detail to FIG. 12, extension member 26B comprises foldable tabs 104, 106. As shown in FIG. 13, connector 24B is provided having holes 42B for removably connecting connector 24B to the host object (shown in FIG. 1, for example) and foldable tabs 100, 102. Extension member 26B is positioned over connector 24B and tabs 104, 106 are folded thereunder and cooperate with tabs 100, 102 to delimit movement of extension member 26B when moving it between the extended and retracted position.

Figure 14:
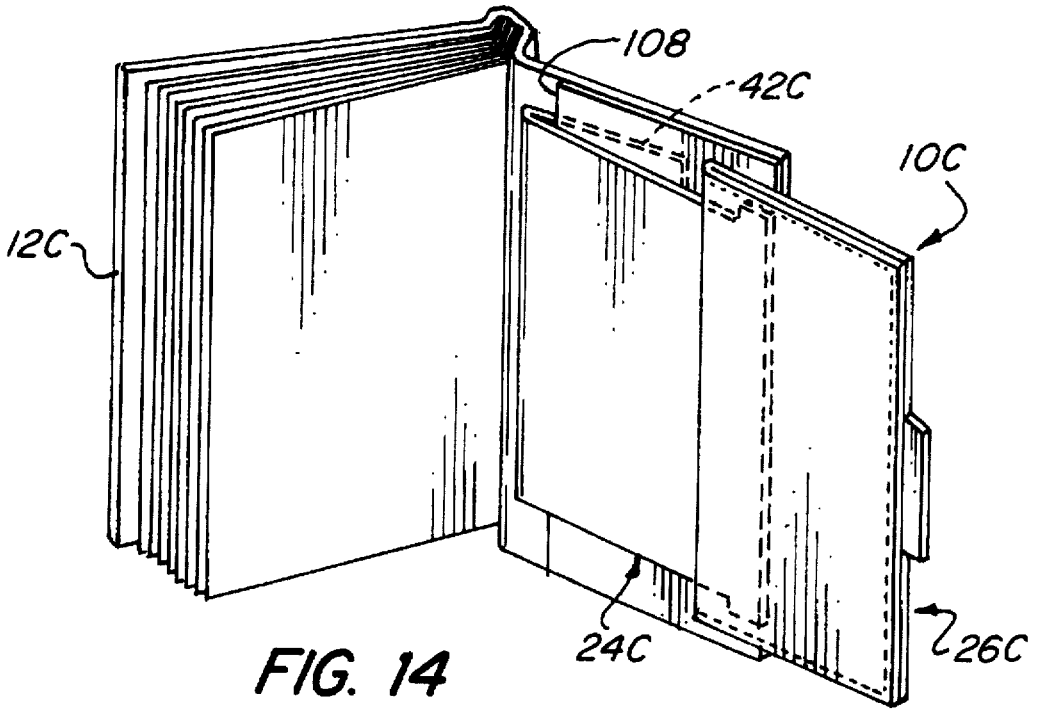
FIG. 14 is an isometric view of an alternate embodiment.
Figure 15:
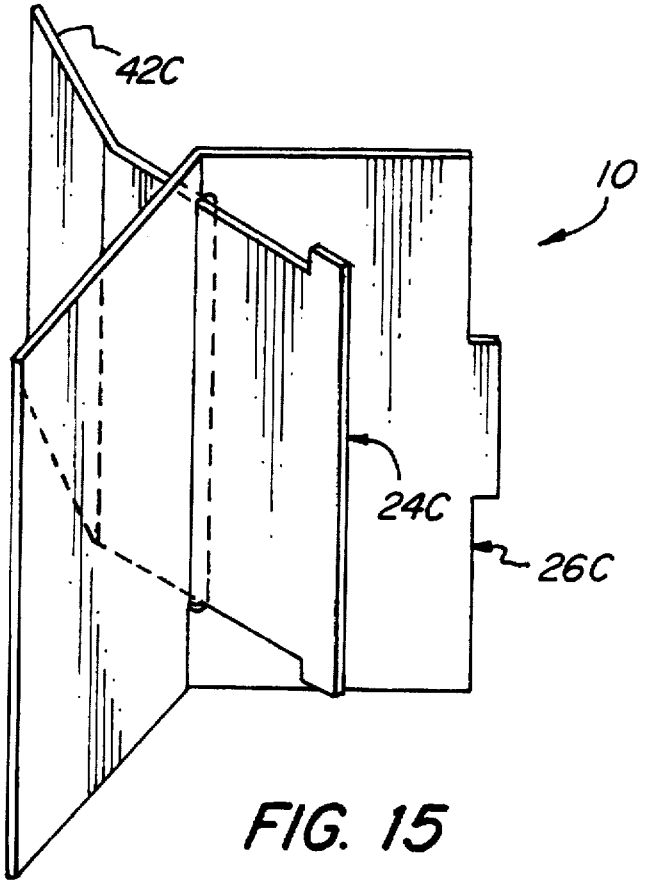
FIG. 15 is a schematic of one of the steps for making the accessory book extension shown in FIG. 14.

In an another alternate embodiment, shown in FIG. 14, the host object 12C comprises a cover 108 which forms a pocket (i.e., pocket part) therewith. Connector 24C comprises connecting means 42C in the form of a flap which is removably insertable into the pocket part so as to removably connect the accessory device 10C to the host object 12C. It should be understood that the remaining components of connector 24C and extension member 26C could take on the form shown or any form discussed above.

It should be understood that additional accessories could be attached to accessory devices 10, 10A, 10B,10C as desired. For example, one could attach spring-loaded clamp (not shown), which is commonly known in the art, to extension member 26, 26A, 26B, 26C for holding loose papers and the like.

It should be understood that the aforementioned device 10, 10A, 10B, 10C offers several advantages over the prior art. For example, extension member 26, 26A, 26B, 26C may be extended in incremental amounts, allowing a user to select the desired amount of writing surface. This is unlike the pivotable devices of the prior art, where the amount of extension can not be selected. Further, the device 10, 10A, 10B, 10C may be used in conjunction with a host material, with little or no interference with the host materials.

It should further be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. An accessory device for use with a host object of the type having a central axis and a plurality of pages at least partially rotatable about the central axis, each of the pages having a remote edge, the accessory device comprising:

a connector having a proximal end and a distal end and means for removably connecting the proximal end of the connector to the host object; and an extension member sized and shaped such that at least a portion of the extension member is slidably movable about the connector in a linear direction so as to move the extension member between an extended position and a retracted position with respect to the connector, the extension member having a proximal end and a distal end, wherein as the extension member slides about the connector from the extended to the retracted position, the proximal end of the extension member is brought closer to the proximal end of the connector, and further wherein as the extension member slides about the connector from the retracted to the extended position, the proximal end of the extension member is brought substantially adjacent to the distal end of the connector such that a substantial portion of the extension member extends beyond the remote edge of at least one of the pages of the host object, the extension member further comprising at least one stop mechanism to delimit movement of the extension member when moving the extension member between the retracted and the extended positions.

2. The accessory device for use with a host object of claim 1, the stop mechanism comprising at least two tabs positioned so as to cooperate with the at least one stop mechanism to delimit movement of the extension member.

3. The accessory device for use with a host object of claim 1, the extension member comprising at least two mounting members, each mounting member being substantially flat, at least two of the mounting members being connected so as to form a pocket therebetween, at least a portion of the connector being slidably movable in a substantially linear direction within the pocket.

4. The accessory device for use with a host object of claim 3, at least one of the mounting members having an outer surface, and wherein the accessory device further comprises at least one pocket formed on the outer surface of the mounting member.

5. The accessory device for use with a host object of claim 1, the extension member further being sized and shaped such that the connecting means is substantially exposed when the extension member is in the retracted position.

6. The accessory device for use with a host object of claim 5, wherein the extension member is made of substantially rigid material.

7. The accessory device for use with a host object of claim 6, wherein the connector is made of substantially rigid material.

8. The accessory device for use with a host object of claim 1, the host object further comprising a cover, the cover having a pocket formed thereon, wherein the connecting means comprises a flap which is removably inserted into the pocket to removably connect the accessory device to the host object.

9. The accessory device for use with a host object of claim 1, the host object further comprising a binder having multiple rings positioned about the central axis, the pages being rotatable about at least one of the rings of the binder, the connecting means having holes, at least one of the holes being sized and shaped to allow at least one of the rings to pass through the hole so as to removably connect the accessory device to the host object.

10. An accessory device for use with a host binder, the host binder having a central axis and a plurality of pages at least partially rotatable about the central axis, each of the pages having a remote edge, the accessory device comprising:

a connector, having a proximal end and a distal end, comprising:

means for removably connecting the proximal end of the connector at least partially to the host binder; and at least one slot which extends at least partially between the proximal end and the distal end of the connector; and an extension member sized and shaped such that at least a portion of the extension member is slidably movable about the connector in a substantially linear direction so as to move the extension member between an extended position and a retracted position with respect to the connector, the extension member having a proximal end and a distal end, wherein as the extension member slides about the connector from the extended to the retracted position, the proximal end of the extension member is brought closer to the proximal end of the connector, and further wherein as the extension member slides about the connector from the retracted to the extended position, the proximal end of the extension member is brought substantially adjacent to the distal end of the connector such that a substantial portion of the extension member extends beyond the remote edge of at least one of the pages of the host binder, and the extension member further comprising at least one stop member disposed in at least a portion of the slot for delimiting movement of the extension member when moving the extension member between the retracted and the extended positions.

11. The accessory device for use with a host binder of claim 10, the extension member comprising at least two mounting members, each mounting member being substantially flat, at least two of the mounting members being connected so as to form a pocket therebetween, at least a portion of the connector being slidably movable in a substantially linear direction within the pocket.

12. The accessory device for use with a host binder of claim 11, at least one of the mounting members further comprising an outer surface, and wherein the accessory device further comprises at least one pocket formed on the outer surface of the mounting member.

13. The accessory device for use with a host binder of claim 12, the extension member being further sized and shaped such that the connecting means is substantially exposed when the extension member is in the retracted position.

14. The accessory device for use with a host binder of claim 13, the host binder further comprising a cover, the cover having a pocket formed thereon, wherein the connecting means comprises a flap which is removably inserted into the pocket to removably connect the accessory device to the host binder.

15. The accessory device for use with a host binder of claim 14, wherein the extension member is made of substantially rigid material.

16. The accessory device for use with a host binder of claim 15, wherein the connector is made of substantially rigid material.

17. A method of making an accessory device comprising the following steps:

forming an extension member from a single sheet of material, the extension member having an outer surface and a plurality of edges;

forming a connector having a plurality of edges and at least one tab extending from at least two of the edges;

placing the connector over at least a portion of the extension member such that the tabs are positioned on at least a portion of the extension member;

folding the extension member so as to encase substantially all of the connector including the tabs therein; and positioning stop members in the extension member so as to cooperate with the tabs of the connector and to delimit movement of the extension member.

18. The method of making an accessory device of claim 17 further comprising the step of forming a pocket on the outer surface of the extension member.

19. An accessory device comprising:

a host object of the type having a central axis and a plurality of pages at least partially rotatable about the central axis, each of the pages having a remote edge;

a connector having a proximal end and a distal end and means for removably connecting the proximal end of the connector to the host object; and an extension member sized and shaped such that at least a portion of the extension member is slidably movable about the connector in a linear direction so as to move the extension member between an extended position and a retracted position with respect to the connector, the extension member having a proximal end and a distal end, wherein as the extension member slides about the connector from the extended to the retracted position, the proximal end of the extension member is brought closer to the proximal end of the connector, and further wherein as the extension member slides about the connector from the retracted to the extended position, the proximal end of the extension member is brought substantially adjacent to the distal end of the connector such that a substantial portion of the extension member extends beyond the remote edge of at least one of the pages of the host object, the extension member further comprising at least one stop mechanism to delimit movement of the extension member when moving the extension member between the retracted and the extended positions.

20. The accessory device of claim 19, the stop mechanism comprising at least two tabs positioned so as to cooperate with the at least one stop mechanism to delimit movement of the extension member.

21. The accessory device of claim 20, wherein the extension member is made of substantially rigid material.

22. The accessory device of claim 21, the host object further comprising a cover, the cover having a pocket formed thereon, wherein the connecting means comprises a flap which is removably inserted into the pocket to removably connect the accessory device to the host object.

* * * * *